US010149574B1

(12) United States Patent
Harder et al.

(10) Patent No.: US 10,149,574 B1
(45) Date of Patent: Dec. 11, 2018

(54) SPA WITH INTEGRATED FOLDING TABLE

(71) Applicant: LMI IP, LLC, Winter Park, FL (US)

(72) Inventors: Gary Harder, Lake Mary, FL (US); David A. Wright, Lakeland, FL (US)

(73) Assignee: LMI IP, LLC, Winter Park, FL (US)

( * ) Notice: Subject to any disclaimer, the term of this patent is extended or adjusted under 35 U.S.C. 154(b) by 0 days.

(21) Appl. No.: 15/704,936

(22) Filed: Sep. 14, 2017

(51) Int. Cl.
*A47K 3/00* (2006.01)
*E04H 4/10* (2006.01)
*E04H 4/14* (2006.01)

(52) U.S. Cl.
CPC ..... *A47K 3/004* (2013.01); *E04H 4/108* (2013.01); *E04H 4/144* (2013.01)

(58) Field of Classification Search
CPC .. A47K 3/004; E04H 2004/0068; E04H 4/14; E04H 4/0031; E04H 4/0037
USPC ..... 211/99
See application file for complete search history.

(56) References Cited

U.S. PATENT DOCUMENTS

| | | | | |
|---|---|---|---|---|
| 4,512,042 | A | 4/1985 | Striegel et al. | |
| 5,228,148 | A * | 7/1993 | Weir | E04H 4/144 4/493 |
| 6,718,566 | B1 | 4/2004 | Wilson | |
| 6,862,755 | B1 | 3/2005 | Crachy | |
| 6,904,625 | B1 | 6/2005 | Podue et al. | |
| 7,739,756 | B2 | 6/2010 | St-Hikaire | |
| 2008/0289094 | A1 * | 11/2008 | Blom | A47K 3/004 4/559 |

* cited by examiner

*Primary Examiner* — Janie Loeppke
(74) *Attorney, Agent, or Firm* — Larson & Larson, P.A.; Frank Liebenow; Justin P. Miller

(57) ABSTRACT

A spa with integrated folding table has a spa shell portion for containing water and a table that is hingedly connected to an upper inside surface of the spa shell. When the table is not being used, the table hinges down, the table lies against an inside surface of the spa shell (e.g. substantially beneath a surface of the water). When the table is in use, the table hinges outward from the upper inside surface of the spa shell in a horizontal plane. A support has a first end hingedly connected to a lower portion of the spa shell and a distal second end for connecting to an underside surface of the table. The support provides structural support to the table when the table is extended (hinges outwardly).

12 Claims, 5 Drawing Sheets

SPA WITH INTEGRATED FOLDING TABLE

FIELD

This invention relates to the field of pools, spas, and hot tubs and more particularly to a spa with an integrated folding table system.

BACKGROUND

Many people enjoy hot tubs or spas for relaxation, and possibly for rehabilitation. A spa or hot tub is generally a small swimming pool that contains water into which a person(s) submerges part or all of their body. There are many shapes and sizes of such spas and many features such as controls, jets for emitting water towards those who are within the water within the spa, waterfalls, etc.

Indifferent to the size, shape, and features of such existing spas, when a spa is located in a location that is exposed to the sun during daylight hours, the users of such spas are exposed to sunlight. As users often stay in the spa for hours, this exposure to sunlight for such long periods of time create a risk of sunburn, as it is not desirable to wear sunscreen in the water as it will contaminate and discolor the water and possibly cause filter and/or plumbing issues within the spa. Further, limiting exposure to the sun is recommended, especially for those with fair skin. Existing spas do not provide a way to block any amount of sunlight during daylight hours.

Further, those spas that are exposed to sunlight during the daytime are also exposed to the elements at any time, for example when it rains, hails, sleets, snows, etc. Although the occupants of the spa are wet from the water within the spa, it is often uncomfortable to have precipitation fall onto the head of the occupants.

Another issue with existing spas relates to entry and exiting to/from the spa. Often, the molded interior shape of the spa shell includes a step-like feature that is used to exit from the water within the spa. Being that the wall height of a typical spa is often two to three feet high, once a user of the spa climbs up this step within the spa shell, they must extend a leg over the spa shell wall and onto the ground surface that is maybe two to three feet below where the user is standing. This creates a high level of imbalance, leaning the user away from the spa. Such imbalance is especially dangerous as the ground surface onto which the user steps is typically painted wood or tile that gets slippery when it is wet.

Still yet another issue with existing spas relates to the enjoyment of food and beverage while one is within the water within the spa. Many people enjoy a beverage such as beer, wine, water, coffee, etc., while sitting in the water within the spa. Many existing spas provide one or more cup holders on upper edge of the spa shell and often offer no place to rest a bag of chips, a bowl of fruit, a plate of cheese, etc. Being that the cup holders are on the upper edge of such spa shells and the users typically sit with their backs toward the upper edge of the spa shells, the cup holders are located substantially behind the users. It is often difficult to twist around and retrieve a drink that is located behind the user, adding to the danger of slipping and hitting one's head in the spa. Further, locating the drink near and behind the user increases the risk of the drink getting knocked out of the cup holders.

If the spa is not heavily occupied by many users, one often makes use of a distant cup holder, perhaps on the opposite side of the spa shell. This reduces the risk of knocking over the drink/cup, but requires that the user maneuver across the spa to retrieve the drink, adding to the danger of slipping and hitting one's head . . . .

What is needed is a spa design that includes an umbrella holder to reduce exposure of spa occupants to sunlight during daylight hours.

SUMMARY

In one embodiment, a spa with integrated folding table includes a spa shell portion for containing water. A table is hingedly connected to an upper inside surface of the spa shell such that the table hinges down and lies against an inside surface of the spa shell when not being used and the table hinges outward from the upper inside surface of the spa shell in a horizontal plane when in use.

In another embodiment, a method of supporting an item above water that is within a spa includes providing a table that is hingedly interfaced to an upper inside surface/wall of a spa shell and extending the table into a horizontal position above the water, then locking the table in the horizontal position.

In another embodiment, a spa with integrated folding table includes a spa shell portion for containing water and a table that is hingedly connected to an upper inside surface of the spa shell. When the table is not being used, the table hinges down, the table lies against an inside surface of the spa shell (e.g. substantially beneath a surface of the water). When the table is in use, the table hinges outward from the upper inside surface of the spa shell in a horizontal plane. A support has a first end hingedly connected to a lower portion of the spa shell and a distal second end for connecting to an underside surface of the table. The support provides structural support to the table when the table is extended (hinges outwardly).

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
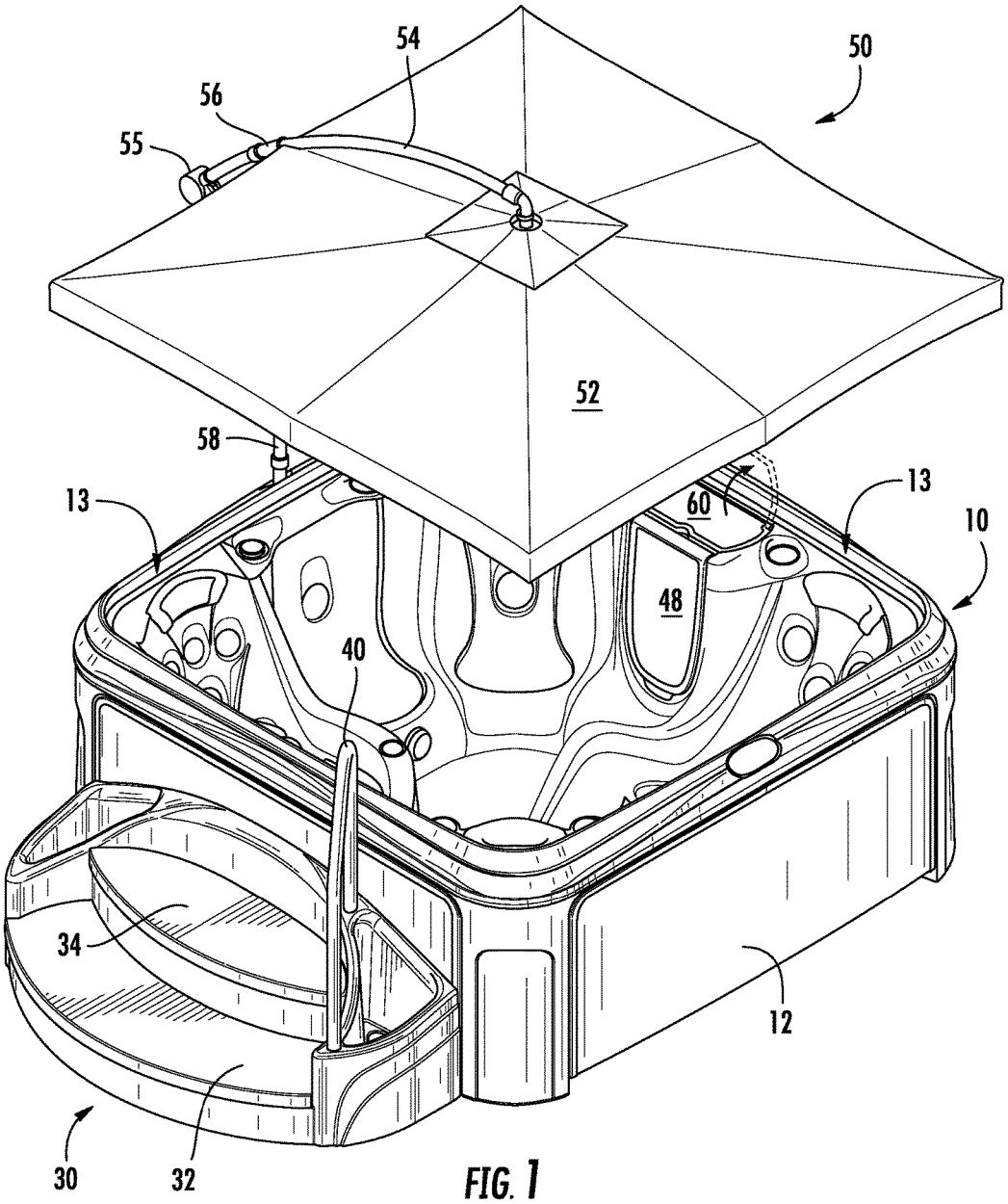
FIG. 1 illustrates a perspective view of a new spa with an integrated umbrella.

Reference will now be made in detail to the presently preferred embodiments of the invention, examples of which are illustrated in the accompanying drawings. Throughout the following detailed description, the same reference numerals refer to the same elements in all figures.

Throughout this description, the term spa is used as a convenient name for a water-holding vessel into which one or more users place their bodies for rest, relaxation, enjoyment, rehabilitation, etc. Therefore, a term spa represents any such vessel, including those that are referred to as hot tubs, swim spas, etc.

Further, the liquid that is contained within the spa is often referred to as water, though it is well known that this liquid often includes more materials other than water (H2O) such as salt, clarifiers, sanitizers, etc.

Many spas are located in areas that are unprotected from the elements and, therefore, are exposed to weather and sunlight. It is well known that exposure to sunlight for long periods of time presents risks of sunburn and, in some cases, skin cancer. Although using sunscreen is often advised when one is exposed to the rays of the sun for lengths of time, sunscreen is often not desired when in a spa, as the sunscreen exits the user's body and enters the water, leading to water clarity issues, filter clogs, loss of protection from the sun, etc. Further, when such spas are exposed (in the open), it becomes less desirable to use the spa during precipitation (e.g. rain, snow, hail, sleet, etc.).

One solution to this issue is to place an umbrella stand next to the spa to provide shade and protection from precipitation. This is effective for a portion of the spa, especially the corner over which the umbrella covers, but typically will not cover the entire spa. Further, it is difficult to place such an umbrella close to the spa, as such umbrellas require a large base that serves as a weighted ballast to keep the umbrella upright.

Figure 2:
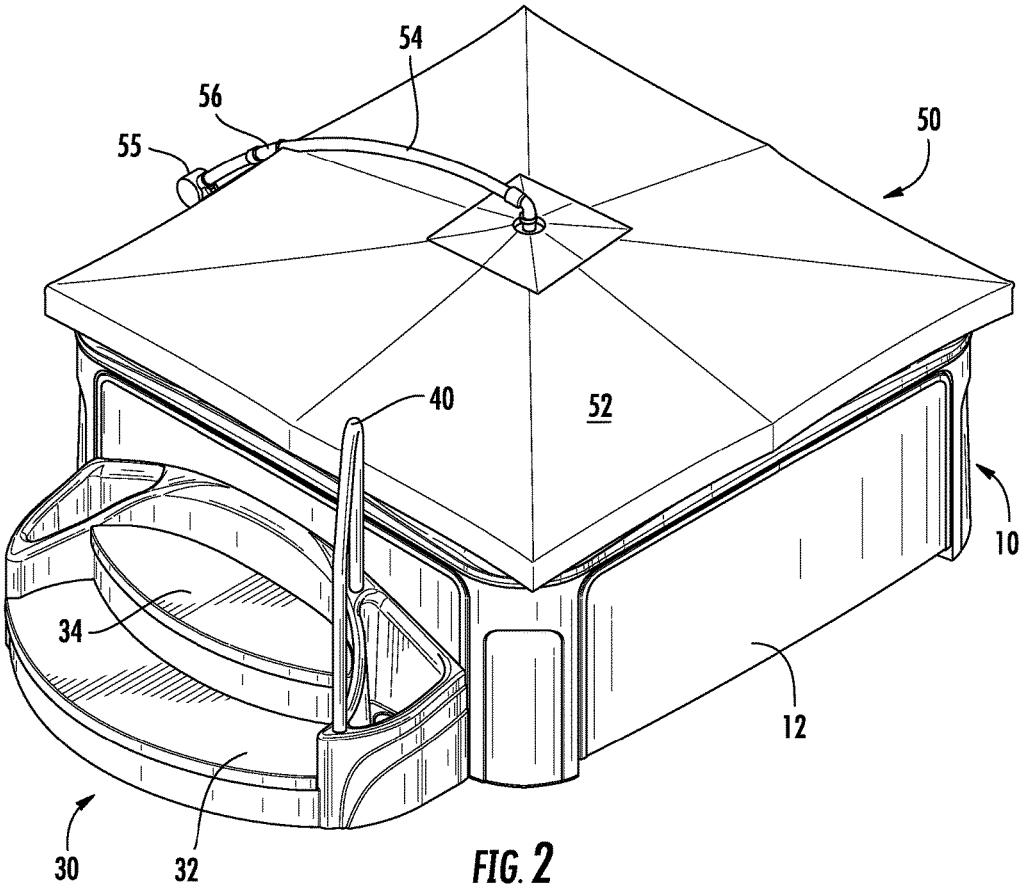
FIG. 2 illustrates a perspective view of the new spa with the integrated umbrella showing the umbrella used as the spa cover.
Figure 3:
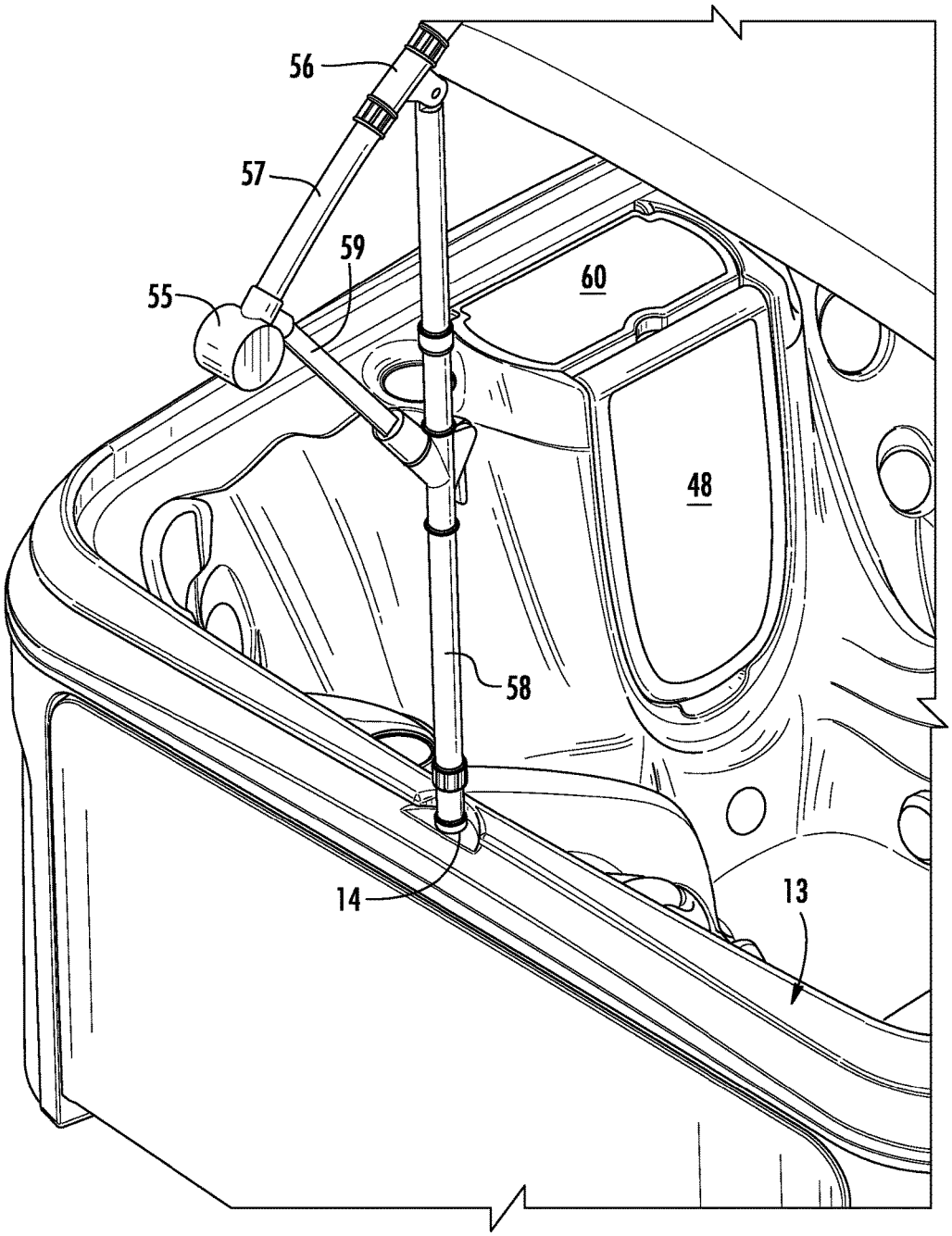
FIG. 3 illustrates a perspective view of the new spa with the integrated umbrella showing the umbrella mounting.

Referring to FIGS. 1 through 3, perspective views of a new spa 10 with an umbrella system 50 integrated into a spa shell 12 of the new spa 10 are shown. Although many sizes, shapes, and styles of umbrella systems 50 are anticipated, the umbrella system 50 used as an example has an umbrella portion 52 that is shaped similar to an outline of the new spa 10 (e.g. if the new spa 10 has a substantially square rim, the umbrella portion 52 also has a substantially square outline as shown). This is desirable to equally shade the entire new spa 10, though not required as an umbrella portion 52 that is round will also provide shade to many areas of the new spa 10.

The umbrella portion 52 of the umbrella system 50 is supported by a boom arm 54 that, in this example, is interfaced to the spa shell 12 by a mast 58 and linkages 55/56/57/59 that provide structure and adjustability in both height of the umbrella portion 52 and/or tilt of the umbrella portion 52, as it is often desired to tilt the umbrella portion when the sun is not directly above or precipitation is directed at an angle instead of straight down.

The spa shell 12 of the new spa 10 includes an integrated umbrella holder that includes a receptacle 14 into which a mast 58 is inserted. In a preferred embodiment, the mast 58 is removable from the receptacle as it is often desired to store the umbrella portion 52 during bad weather or to exchange the umbrella portions 52 as the umbrella portion 52 ages or for decorative reasons. As the new spa 10 often contains substantial amounts of water (e.g. typically one hundred to five hundred gallons) having considerable weight (e.g. 800 pounds to 4000 pounds), the spa provides sufficient ballast so as to not allow the umbrella system 50 to tip over. In such, the receptacle 14 relays the ballast from the water to the umbrella system 50, maintaining the mast 58 in an upright, preferably vertical position, though there is no requirement that the mast 58 be vertical.

The receptacle 14 is shown in an upper edge 13 of the spa shell 12, though there is no limitation as to the location of the receptacle 14 as it is fully anticipated that the receptacle 14 be located on an outer side of the spa shell, at any location along the upper edge 13 of the spa shell 12, or, even within the containment area of the spa shell 12. In the later, it is anticipated that the water containment area of the spa shell 12 include the receptacle 14 at a location beneath where water is filled into the new spa 10 and, therefore, the mast 58 will extend upwards out of the water when the new spa 10 is filled with water. In this embodiment, it is anticipated that the umbrella system 50 be of a central-mast type (e.g. for example those that are used as beach umbrellas) and the mast 58 be made of a material that is compatible with the water within the new spa 10, including sanitizing chemicals, etc.

As shown in FIG. 2, in some embodiments, when the umbrella portion 52 is of a shape and size that is similar or slightly larger than the outer rim of the spa shell 12, the umbrella portion 52 doubles as a spa cover when the umbrella portion 52 is lowered to rest upon and interface with the upper edge 13 of the spa shell 12. Many spas have a separate cover that is taken off and stored while using the spa and returned to cover the spa when not in use to prevent thermal loss and to maintain water quality/cleanliness. Such covers are typically large and difficult to maneuver and stow, making the spa experience less enjoyable and difficult for those with mobility issues.

When the umbrella portion 52 rests on the upper edge 13 of the spa shell 12, the umbrella portion 52 provides a cover for the new spa 10 that maintains water temperature, reduces evaporation, and reduces introduction of foreign objects into the new spa 10 (e.g. leaves, insects, airborne sand/dirt, etc.). The umbrella portion 52 is lowered/raised in any way known in the art of umbrellas, hence it is anticipated that in some embodiments, a mechanism that includes a crank system is included to lower/raise the umbrella portion 52 with minimal effort and such provides access to some users who would have had difficulty removing/replacing prior spa covers due to various mobility issues.

Also shown in FIGS. 1 and 2 are the optional integrated stair system 30 with steps 32/34 and railing 40. Although optional, the integrated stair system 30 is described in more detail along with FIGS. 4 and 5.

Also shown in FIGS. 1 and 3 is the optional integrated folding table 48 with the further optional integrated cooler that is located beneath the cooler cover 60. Although optional, the integrated folding table 48 and integrated cooler located beneath the cooler cover 60 are described in more detail along with FIGS. 4 and 5 described in more detail along with FIGS. 4 and 5.

Figure 4:
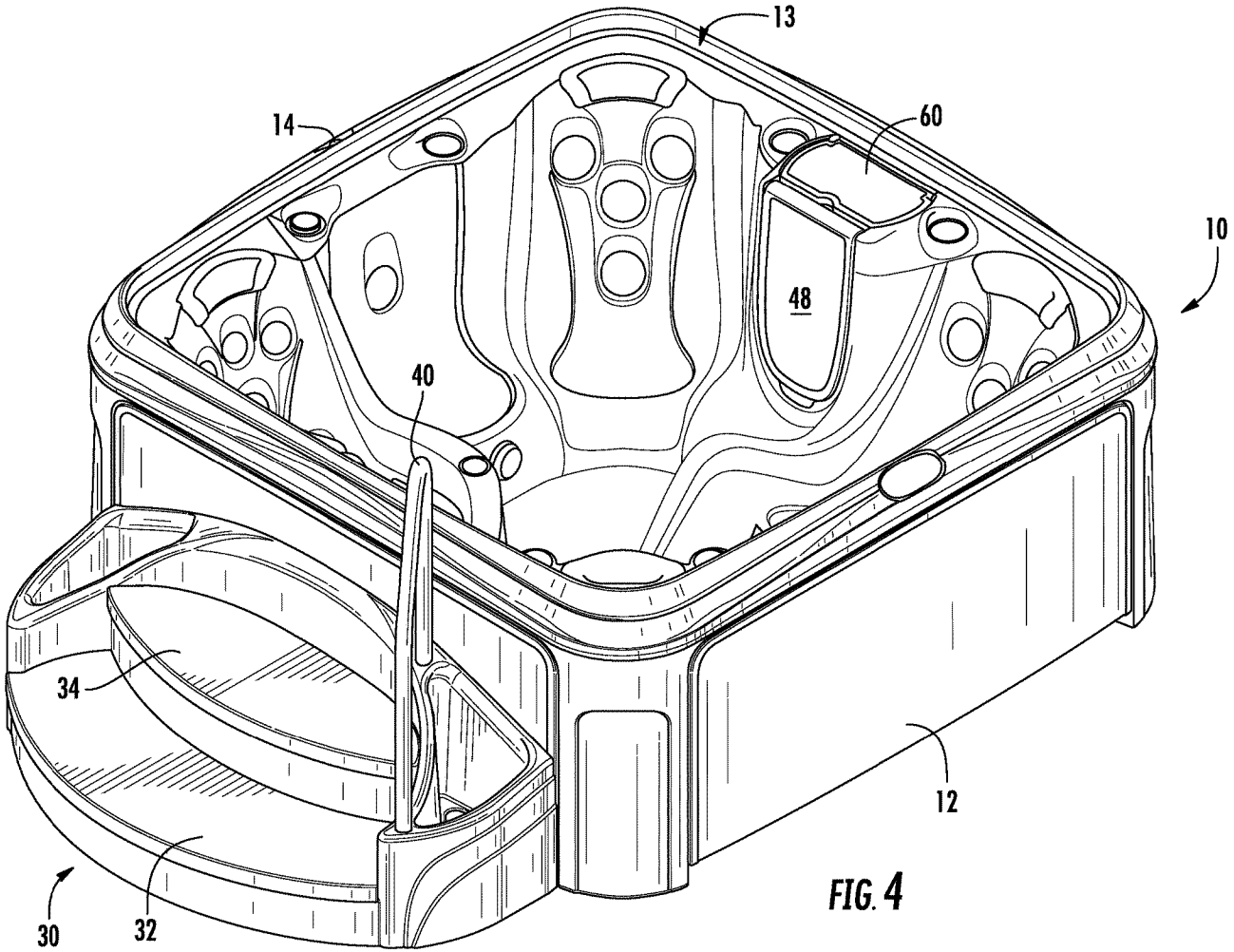
FIG. 4 illustrates a perspective view of a new spa with an integrated folding table in a retracted position.
Figure 5:
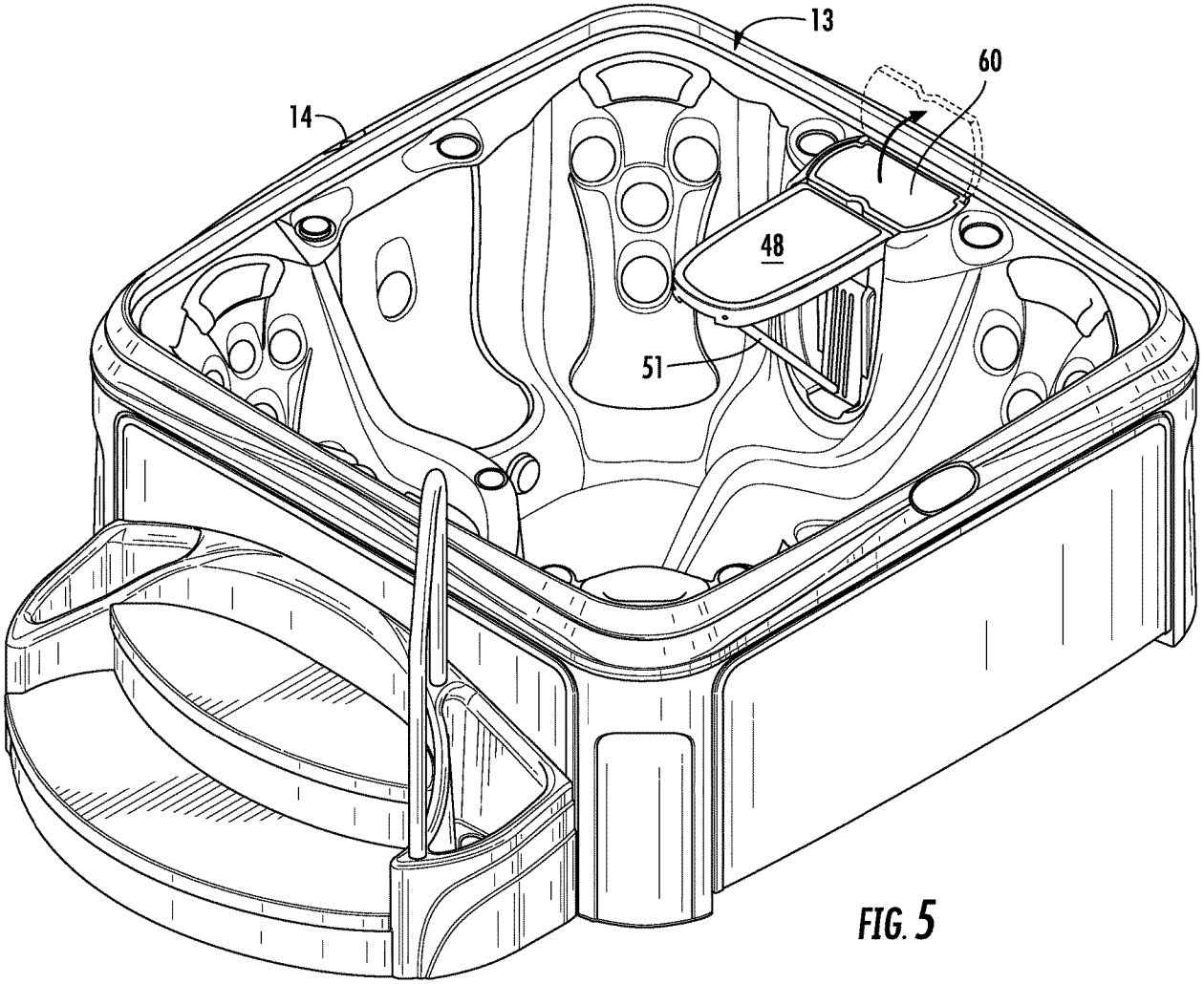
FIG. 5 illustrates a perspective view of the new spa with the integrated folding table in an extended position.

Referring to FIGS. 4 and 5 perspective view of a new spa 10 with an integrated folding table 48 that is integrated into the spa shell 12 are shown in a retracted position in FIG. 3 and in an extended position in FIG. 4.

As discussed, an issue with existing spas relates to the enjoyment of food and beverage while one is within the water within the prior art spa. Many people enjoy a beverage such as beer, wine, water, coffee, etc., while sitting in the water within the spa. Many existing spas provide one or more cup holders on an upper edge of the spa shell and often offer no place to rest a bag of chips, a bowl of fruit, a plate of cheese, etc. Being that the cup holders are on the upper edge of such prior art spa shells and the users typically sit with their backs toward the upper edge of those cup holders, the cup holders are located substantially behind the users. It is often difficult to twist around and retrieve a drink that is located behind the user, adding to the danger of slipping and hitting one's head in the prior art spa. Further, locating the drink near and behind the user increases the risk of the drink getting knocked out of the cup holders.

The new spa 10 provides an integrated folding table 48 that is shown in a retracted position in FIG. 4 and in an extended position in FIG. 5. The integrated folding table 48 is hingedly connected to the spa shell 12 at an upper inside surface of the spa shell 12 so that when the integrated folding table 48 is extended, the integrated folding table is substantially horizontal (a top of the integrated folding table 48 is in a horizontal plane) and positioned above the surface of the water in the new spa 10. In the retracted position as shown in FIG. 4, the integrated folding table 48 is rotated downward so as to not be in the way of users of the new spa 10, allowing for improved access. In the extended position as shown in FIG. 5, various items or objects are anticipated to be placed on the surface of the table 48 (e.g. items such as drinks, bowls, plates, communication devices, music players, etc.). Although there are many ways to maintain the extended position of the table 48, in some embodiments, one or more supports 51 provide an angled support to provide stability to the table 48, though other locking mechanisms are equally anticipated such as detents or locking hinge assemblies. In such, a first end of the support(s) 41 is hingedly interfaced to an lower inside surface of the spa shell 12 and a distal second end of the support(s) 41 interface with the table 48 at a location distal from where the table is hingedly connected to the upper inside surface of the spa shell 12.

To further improve the dining and/or beverage experience of the new spa 10, in some embodiments, an insulated compartment or cooler is provided beneath the cooler cover 60 that hingedly opens as in FIG. 1 and FIG. 5. This compartment is thermally insulated from water within the new spa 10, being that the insulated compartment is typically provisioned with a cooling substance such as ice, dry ice, icepacks, etc.

As previously discussed, entry and exiting to/from the prior-art spa is often difficult due to the height of the prior-art spa shell. Often, the molded interior shape of the spa shell includes a step-like feature that is used to exit from the water within the prior art spa. The wall height of a typical prior-art spa is often two to three feet high, once a user of the spa climbs up this step within the spa shell, they must extend a leg over the spa shell wall and onto the ground surface that is maybe two to three feet below where the user is standing. This creates a high level of imbalance, leaning the user away from the prior art spa. Such imbalance is especially dangerous as the ground surface onto which the user steps is typically painted wood or tile that gets slippery when it is wet.

In some embodiments, the new spa 10 includes an integrated stair system 30 that is integrated into or connected to the new spa 10 for use when entering and exiting the new spa 10. The integrated stair system 30 is formed as part of or attached to the spa shell 12 and, therefore, does not separate from the spa shell 12 as a user is utilizing the integrated stair system 30. Although shown with a lower step 32 and an upper step 34, any number of steps is anticipated. In some embodiments, a railing 40 is included for safety reasons. Although the optional railing 40 is shown of a particular size and shape, there is no limitation as to the location, size, shape, contour, etc., of the optional railing 40.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A spa with integrated folding table, the spa comprising:
a spa shell portion for containing water; and
a table directly connected to a hinge, the hinge directly connected to an upper surface of an inside wall of the spa shell such that the table hinges downwardly and lies against an inside surface of the spa shell when not being used and the table hinges upwardly and outwardly from the upper inside surface of the spa shell in a horizontal plane when in use.

2. The spa with integrated folding table of claim 1, further comprising a support, a first end of the support is directly connected to a lower portion of the inside wall of the spa shell by a second hinge and a distal second end of the support connects to an underside surface of the table for providing structural support to the table when the table is folded outwards.

3. The spa with integrated folding table of claim 1, further comprising an integrated stair system for entering and exiting the spa, the integrated stair system molded with the spa shell portion and the integrated stair system juts away from an outside wall of the spa shell portion.

4. The spa with integrated folding table of claim 3, further comprising a railing interfaced to the integrated stair system.

5. The spa with integrated folding table of claim 1, further comprising a receptacle for receiving an umbrella system, the receptacle integrated into an upper edge of the spa shell.

6. A method of supporting an item above water that is within a spa, the method comprising:
providing a table directly connected to a hinge, the hinge directly connected to an upper surface of an inside wall of a spa shell;
extending the table into a horizontal position above the water; and
locking the table in the horizontal position.

7. The method of claim 6, wherein the step of locking is performed by extending a support, a first end of the support is directly connected to a second hinge, the second hinge directly connected to a lower portion of the inside wall of the spa shell and a distal second end of the support connects to an underside surface of the table.

8. The method of claim 6, further comprising the step of:
unlocking the table; and
retracting the table into a vertical position against an inside surface of the spa shell.

9. A spa with integrated folding table, the spa comprising:
a spa shell portion for containing water;
a table directly connected to a hinge, the hinge directly connected to an upper surface of an inside wall of the spa shell such that the table hinges downwardly and lies against an inside surface of the spa shell when not being used and the table hinges upwardly and outwardly from the upper inside surface of the spa shell in a horizontal plane when in use; and
a support, a first end of the support is directly connected to a second hinge, the second hinge directly connected to a lower portion of the spa shell wall and a distal second end of the support connects to an underside surface of the table for providing structural support to the table when the table hinges outward from the upper inside surface of the spa shell.

10. The spa with integrated folding table of claim 9, further comprising an integrated stair system for entering and exiting the spa, the integrated stair system molded with the spa shell portion and the integrated stair system jutting away from an outside wall of the spa shell portion.

11. The spa with integrated folding table of claim 10, further comprising a railing interfaced to the integrated stair system.

12. The spa with integrated folding table of claim 9, further comprising a receptacle for receiving an umbrella system, the receptacle integrated into an upper edge of the spa shell.

* * * * *